United States Patent [19]

Wignall

[11] 4,103,630

[45] Aug. 1, 1978

[54] TUFTING MACHINES AND METHOD

[75] Inventor: Norman Wignall, Blackburn, England

[73] Assignee: Cupa Engineering Co. Ltd., England

[21] Appl. No.: 687,426

[22] Filed: May 17, 1976

[51] Int. Cl.[2] ..... D05C 15/16

[52] U.S. Cl. ..... 112/79 R; 112/266; 112/410

[58] Field of Search ..... 112/266, 262, 411, 410, 112/79 R, 79 A, 79.5, 197, 198, 199; 66/85 A

[56] References Cited

U.S. PATENT DOCUMENTS

| | | | |
|---|---|---|---|
| 2,705,465 | 4/1955 | Lacey | 112/79 R |
| 3,230,917 | 1/1966 | Wignall et al. | 112/266 |
| 3,340,839 | 9/1967 | Ketterer | 112/410 |
| 3,376,835 | 4/1968 | Watkins | 112/266 X |
| 3,722,442 | 3/1973 | Mac Isaac et al. | 112/266 X |
| 3,934,524 | 1/1976 | Smith | 112/79 A |

FOREIGN PATENT DOCUMENTS

| | | | |
|---|---|---|---|
| 503,779 | 7/1930 | Fed. Rep. of Germany | 112/79 R |

*Primary Examiner*—H. Hampton Hunter
*Attorney, Agent, or Firm*—John C. Smith, Jr.

[57] ABSTRACT

A double sided pile fabric is formed by a reciprocating needle in cooperation with latchless loppers on opposite sides of the base fabric, the reciprocating needle guiding the yarn through the base fabric to form loops on opposite sides thereof. The latchless lopper on one side retains alternate loops in the path of the needle so that the adjacent loops are formed inside the alternate loops after which the alternate loops are pulled taut about the adjacent loops.

14 Claims, 13 Drawing Figures

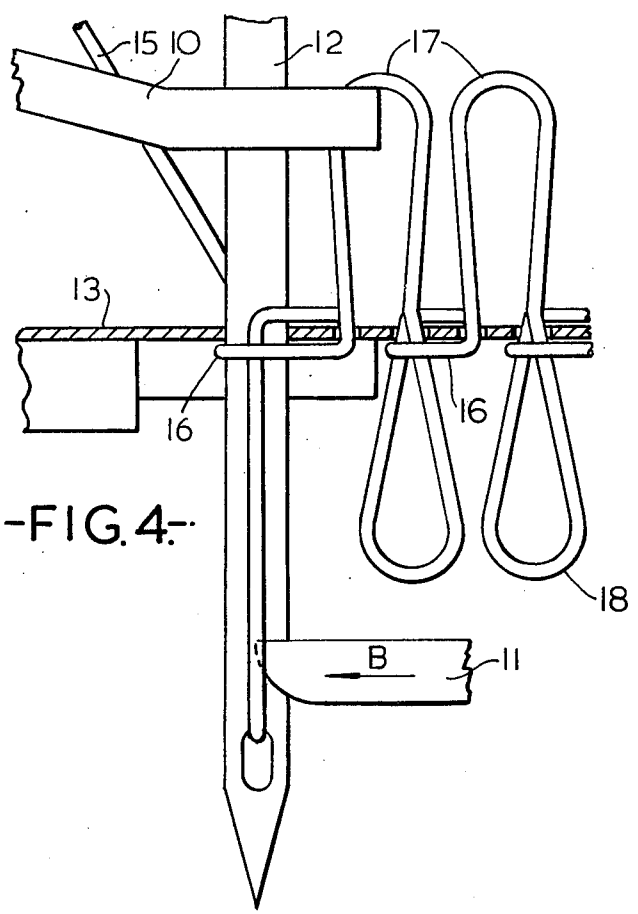
-FIG. 4-
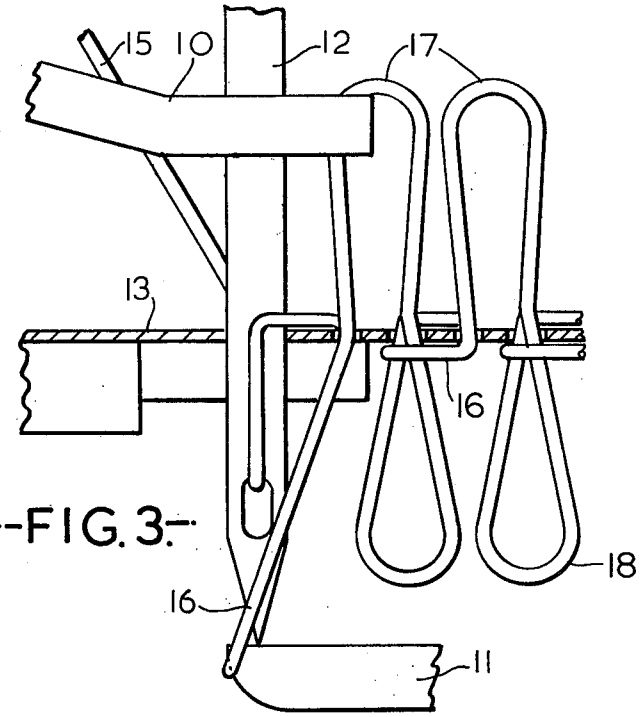
-FIG. 3-

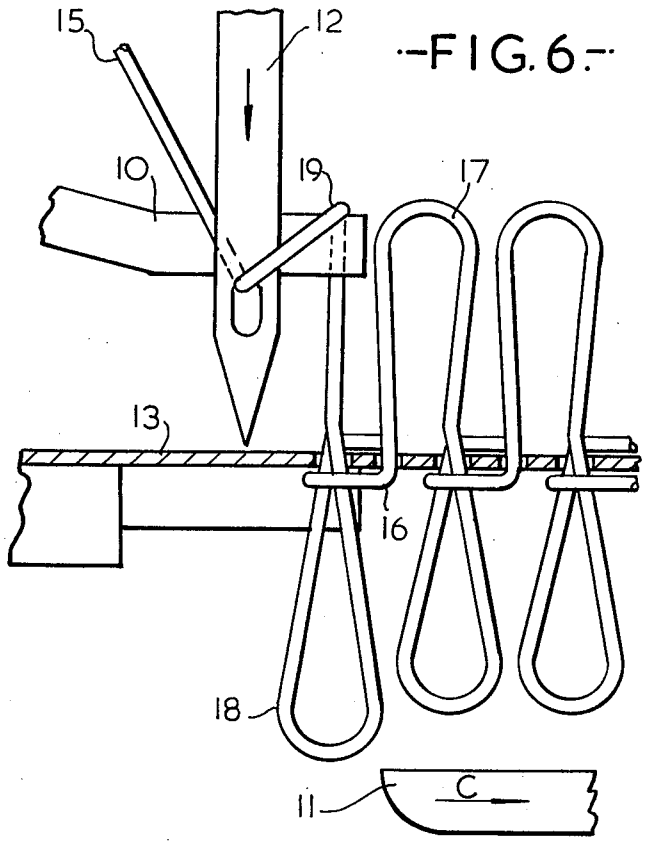
-FIG. 6-
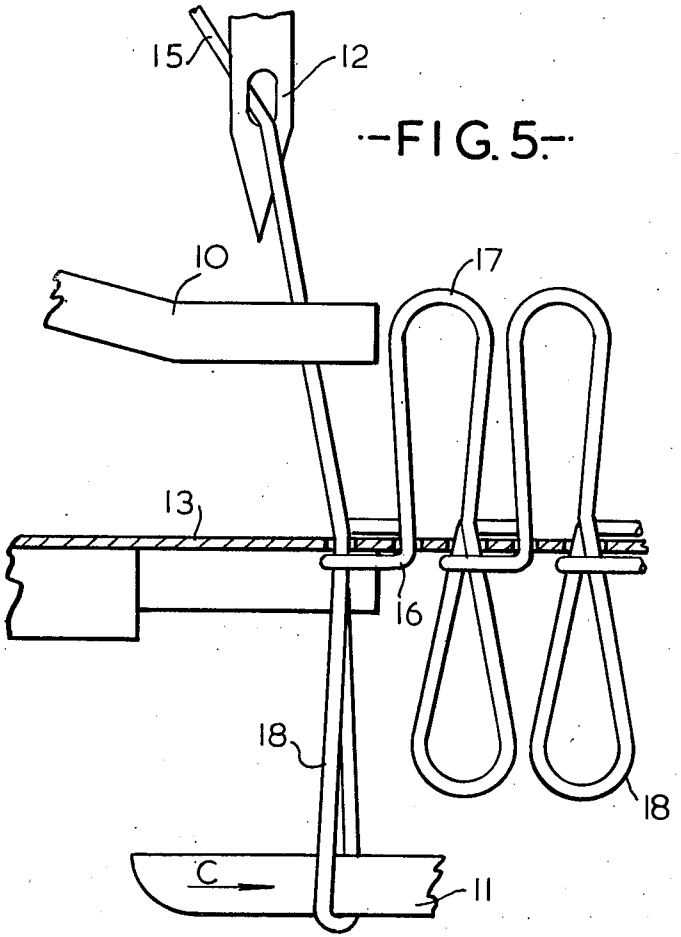
-FIG. 5-

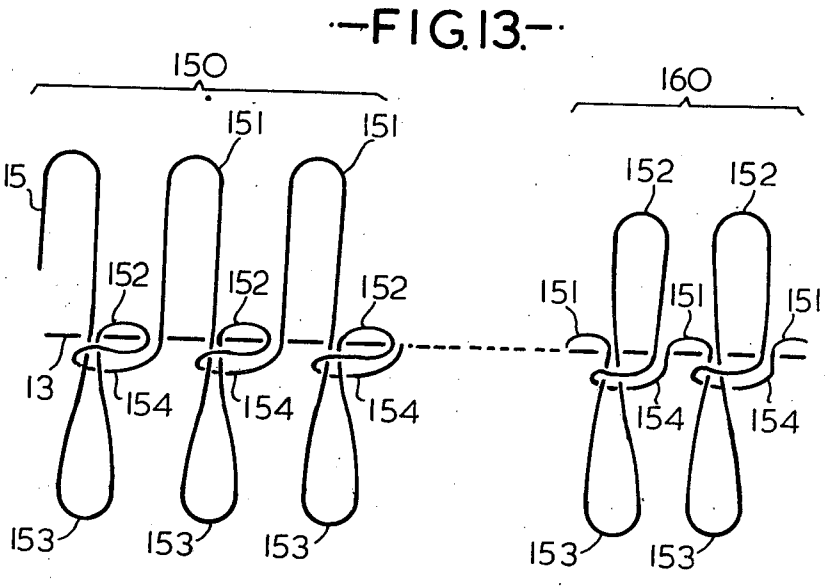
-FIG. 13-
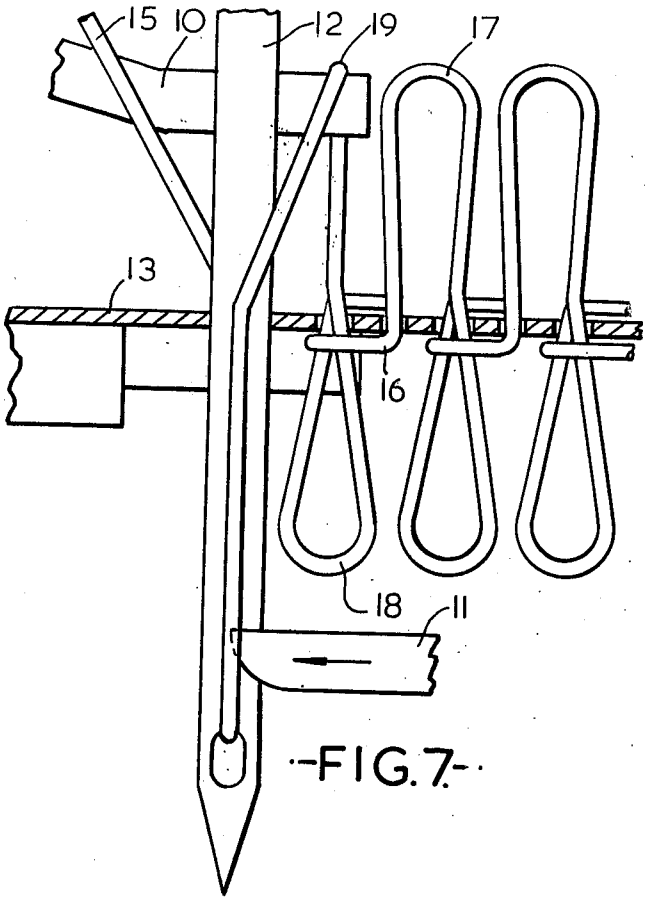
-FIG. 7-

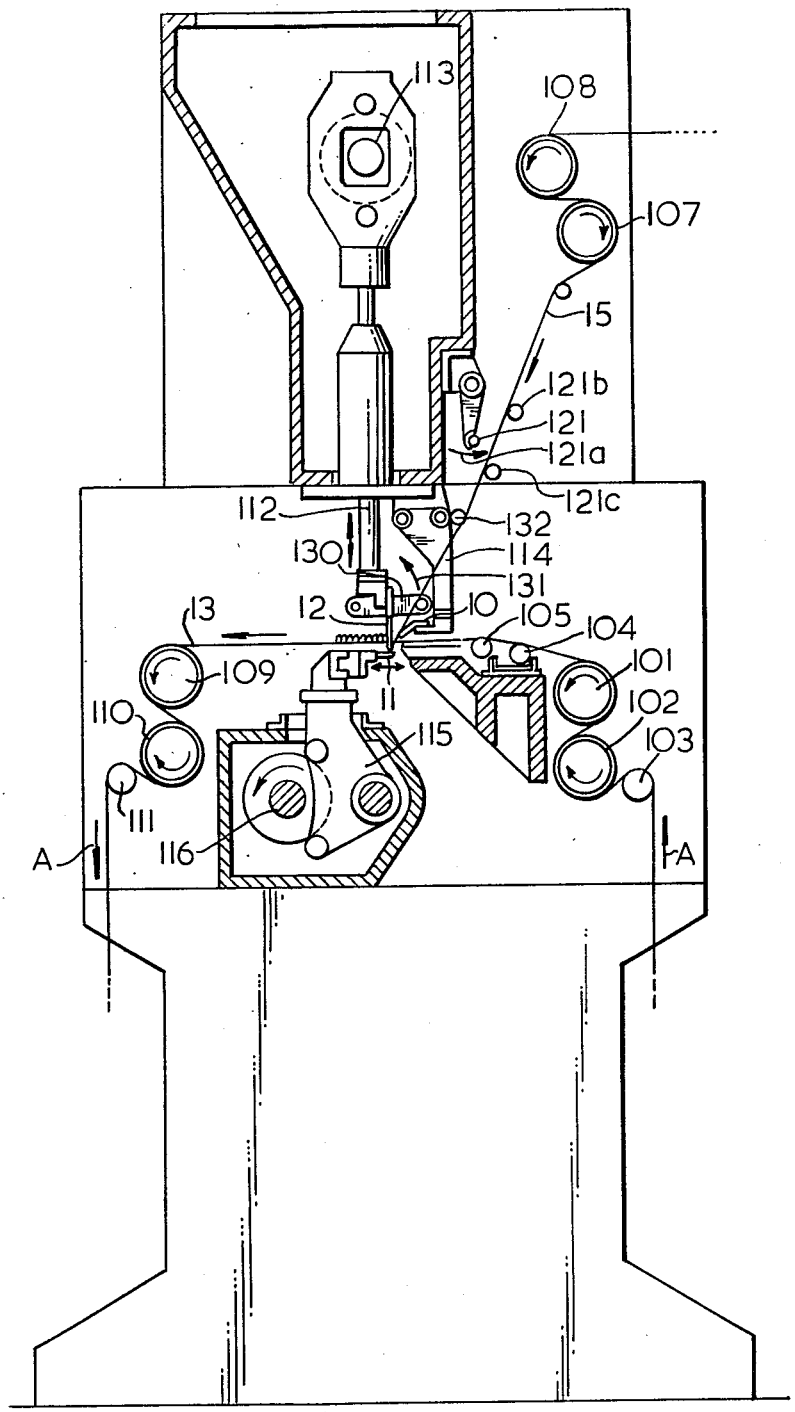
-FIG. 9-

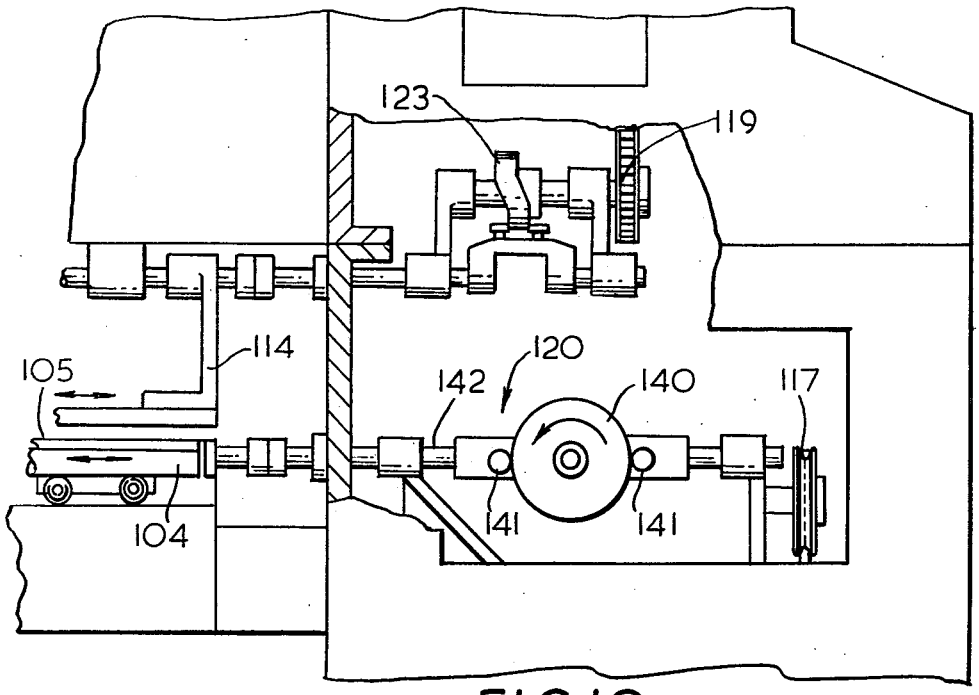
-FIG. 10.-
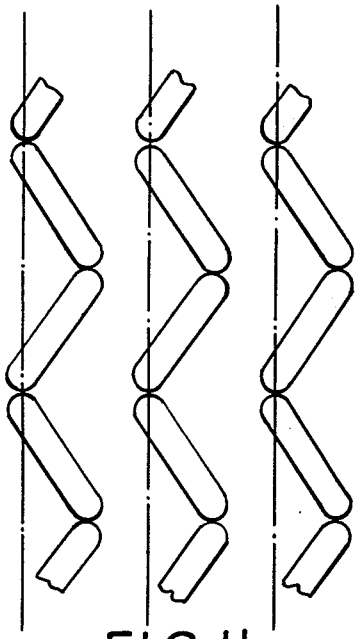
-FIG. 11.-
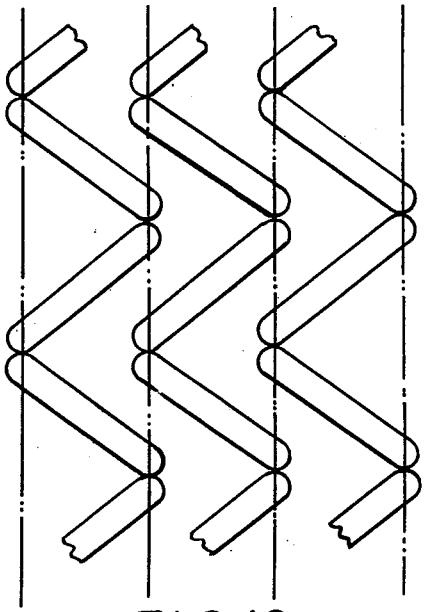
-FIG. 12.-

TUFTING MACHINES AND METHOD

BACKGROUND OF THE INVENTION

The invention relates to the manufacture of double sided pile fabrics, and to machines for manufacturing double sided pile fabrics, sometimes known as tufting machines.

BRIEF DESCRIPTION OF THE PRIOR ART

It is known to produce double sided pile fabrics by stitching a yarn into a base fabric to provide pile loops but in order to provide pile loops on both sides of the fabric which are locked in position and will not readily pull out it is necessary for at least some loops to be formed as non-pile loops which pass around the pile loops and are drawn tight to hold the pile loops in position. Hitherto it has been thought necessary to utilise latched needles or other complex devices to perform the interlacing of the loops. For example each latched needle may pass through one loop, grasp an adjacent loop, and draw the grasped loop through the said one loop before releasing the grasped loop. This grasping and releasing cannot be performed by simple closed eye needles but latched needles are more expensive and there is a tendency for the latches to become worn or even break off.

OBJECT OF THE INVENTION

It is an object of the invention to provide a method of manufacturing a double sided pile fabric which does not require the use of latched needles or other complicated devices. It is also an object of the invention to provide a machine for carrying out the method.

SUMMARY OF THE INVENTION

I have now discovered that the necessary interlacing of loops can be achieved using a simple eyed needle and two simple loopers, one on each side of the base fabric. The needle reciprocates in a simple manner through the base fabric and one of the loopers is used to move alternate loops from one side of the base fabric into the path of adjecent loops being formed, so that each adjacent loop is formed through one of the alternate loops. Accordingly the invention provides a method of manufacturing a double sided pile fabric comprising using an eyed needle to pass a yarn through a base fabric at a succession of spaced-apart points so that there is a succession of contiguous loops on one side of the base fabric and a succession of spaced-apart loops on the other side of the base fabric, a first looper on the said one side of the fabric being used to hold alternate loops away from the base fabric on the said one side of the base fabric to form a first set of pile loops on the said one side of the base fabric, the loops in between the pile loops of the first said set being drawn against the base fabric to form a first set of non-pile loops, a second looper on the said other side of the fabric being used to hold alternate loops away from the base fabric on the said other side of the base fabric to form a second set of pile loops on the said other side of the base fabric, the loops in between the pile loops of the said second set each being passed around an adjacent pile loop before being drawn tight to form a second set of non-pile loops so that a continuous chain stitch is formed, each of said second set of non-pile loops being passed around an adjacent pile loop by forming the non-pile loops around the said second looper, displacing the base fabric with respect to the said second looper, passing the needle through the fabric so that a further loop is formed, drawing the said non-pile loop off the looper so that it is pulled tightly around the said further loop, retaining the said further loop on the said second looper to form a pile loop, and withdrawing the needle.

The invention also provides a machine for manufacturing a double sided pile fabric comprising an eyed needle, drive means to reciprocate the needle through a base fabric, means to feed the fabric past the needle so that as the needle reciprocates, a yarn passing through the eye of the needle is passed through the base fabric at a succession of spaced-apart points so that there is a succession of contiguous loops on one side of the fabric and a succession of spaced-apart loops on the other side of the fabric, a first looper, means to provide relative displacement between the first looper and the needle so that on alternate strokes of the needle the needle travels along one side of the said first looper and then back along the other side of the said first looper, so that alternate loops of the yarn are held away from the base fabric to form a first set of pile loops on the said one face of the base fabric, a second looper, a means to move the second looper relative to the needle such that the second looper moves into the path of the adjacent loop as the adjacent loop is formed, and the said second looper then holds the said adjacent loop clear of the base fabric to form a pile loop, the machine including means to pull each said alternate loop tight around the adjacent pile loop so that a second set of pile loops is formed on the said other side of the base fabric.

BRIEF DESCRIPTION OF THE DRAWINGS

FIGS. 1 to 7 show successive stages of a single cycle during the production of a double pile fabric by one embodiment of the method according to the invention;

FIG. 9 is a diagrammatic vertical section on line IX—IX of FIG. 8;

FIG. 10 is a more detailed front view of part of one side of the machine, showing part of the internal mechanism of the machine;

FIG. 11 is a plan view of a fabric produced by the machine;

FIG. 12 is a plan view of an alternative fabric produced by the machine; and FIG. 13 illustrates diagrammatically two alternative stitch formations which can be produced by the method according to the invention.

DETAILED DESCRIPTION OF EMBODIMENTS OF THE INVENTION

The production of a double pile fabric will be described with reference to FIGS. 1 to 7, using a single set of parts, namely a top looper 10, and associated bottom looper 11, and one eyed needle 12.

Figure 1:
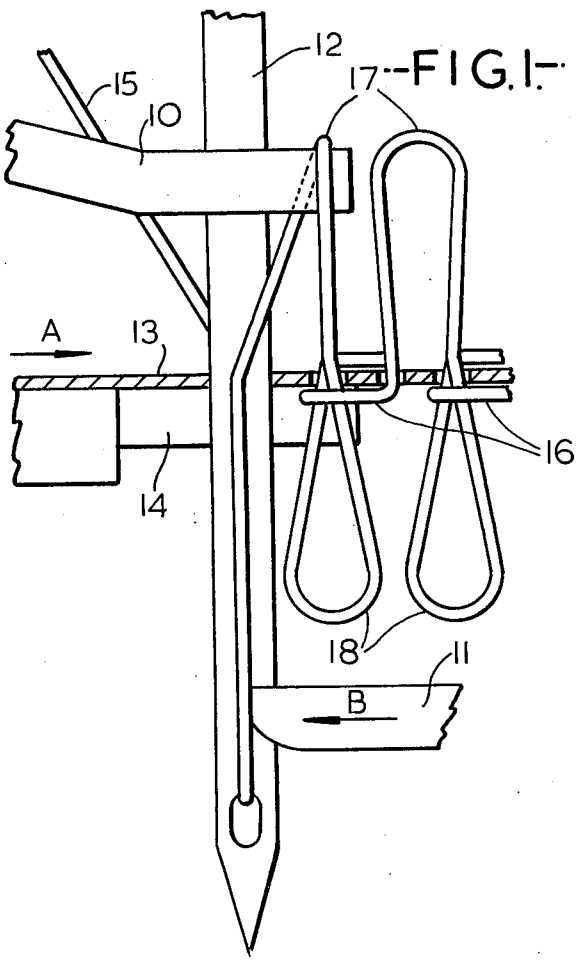

A base fabric 13 is fed in the direction of arrow A in FIG. 1. The needle 12 reciprocates vertically through a reed dent 14. The movements of the loopers and needle are controlled by cams described below and in FIG. 1 the parts are at the start of one stitching cycle with the needle 12 at bottom dead centre. The yarn 15 from the previous stitch extends downwardly through the reed dent, passes through the eye of the needle, and up the other side of the needle to a yarn supply not shown.

During the first 68° of rotation of the cams the bottom looper 11 moves in the direction of arrow B of FIG. 1 to slide between the yarn 15 and the needle 12 and the needle then rises to a position in which it is just clear of the upper surface of the fabric 13, leaving a loop of yarn 16 (FIG. 2) around the bottom looper. The fabric then moves forward by one pitch so that the position shown in FIG. 2 is reached, with the previously formed upper pile loop 17 drawn off the end of the upper looper 10 and the needle 12 positioned to re-penetrate the fabric at a new location.

Figure 2:
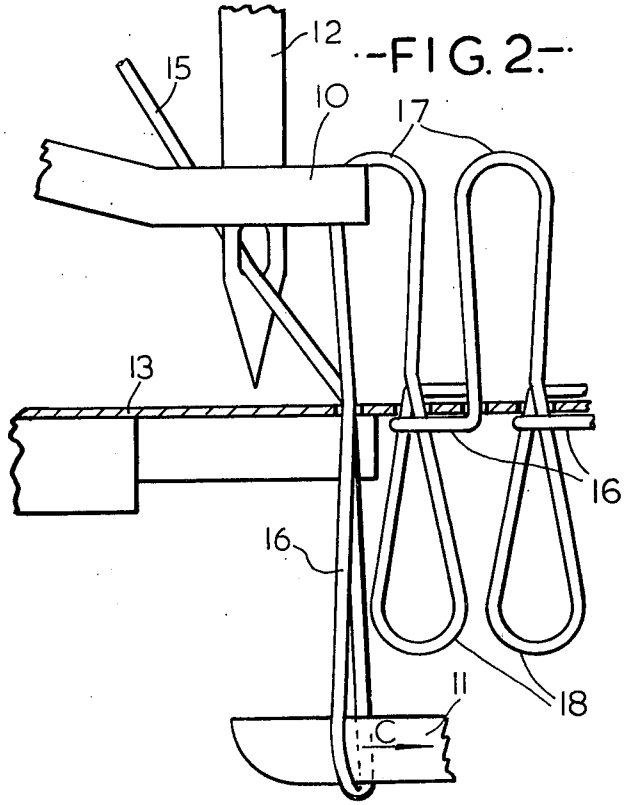

After a further 42° of cam rotation the bottom looper 11 has retracted slightly in the direction of arrow C of FIG. 2 and has reached a dwell position shown in FIG. 3. At the same time the needle 12 has moved downwardly to a dwell position in which the point of the needle touches or lies closely adjacent to the upper surface of the free end of the bottom looper 11. The looper 11 lies in the path of the new loop which is being formed by the needle 12. The yarn is tightened when the needle and bottom looper are in the dwell position shown in FIG. 3 and this causes the loop 16 to move obliquely with respect to the base fabric 13 and to slide off the curved underside of the bottom looper 11 and slide around the needle, and hence around the loop which is being formed by the needle.

The bottom looper then retracts further to move clear of the needle, the needle moves down to bottom dead centre once more, and the bottom looper then returns in the direction of arrow B, as shown in FIG. 4, the cycle now being half completed, the cams having rotated 180° from their starting position.

During the next 90° of cam rotation the needle rises to a point at which it lies above the top looper 10, which until this point in the cycle has remained stationary. However the top looper now moves one pitch sideways, across the width of the fabric. Also the fabric moves forward one pitch and the bottom looper begins to retract in the direction of arrow C, so that the position shown in FIG. 5 is reached.

The bottom looper now withdraws completely from the new bottom pile loop 18 which has been formed, and the needle starts to move downwardly again. Because of the sideways movement of the upper looper, the needle descends on the opposite side of the top looper, thereby starting the formation of a new upper pile loop 19, as shown in FIG. 6.

During the last stages of the cycle, both the cams complete 360° of rotation, the needle pierces the fabric once again, returning to bottom dead centre, and the bottom looper moves in the direction of arrow B to commence picking off a new bottom loop. The cycle then repeats itself, with the exception that the top looper 10 returns to its original position after 270° of cam rotation, and does not continue indexing in the same direction across the cloth.

Figure 8:
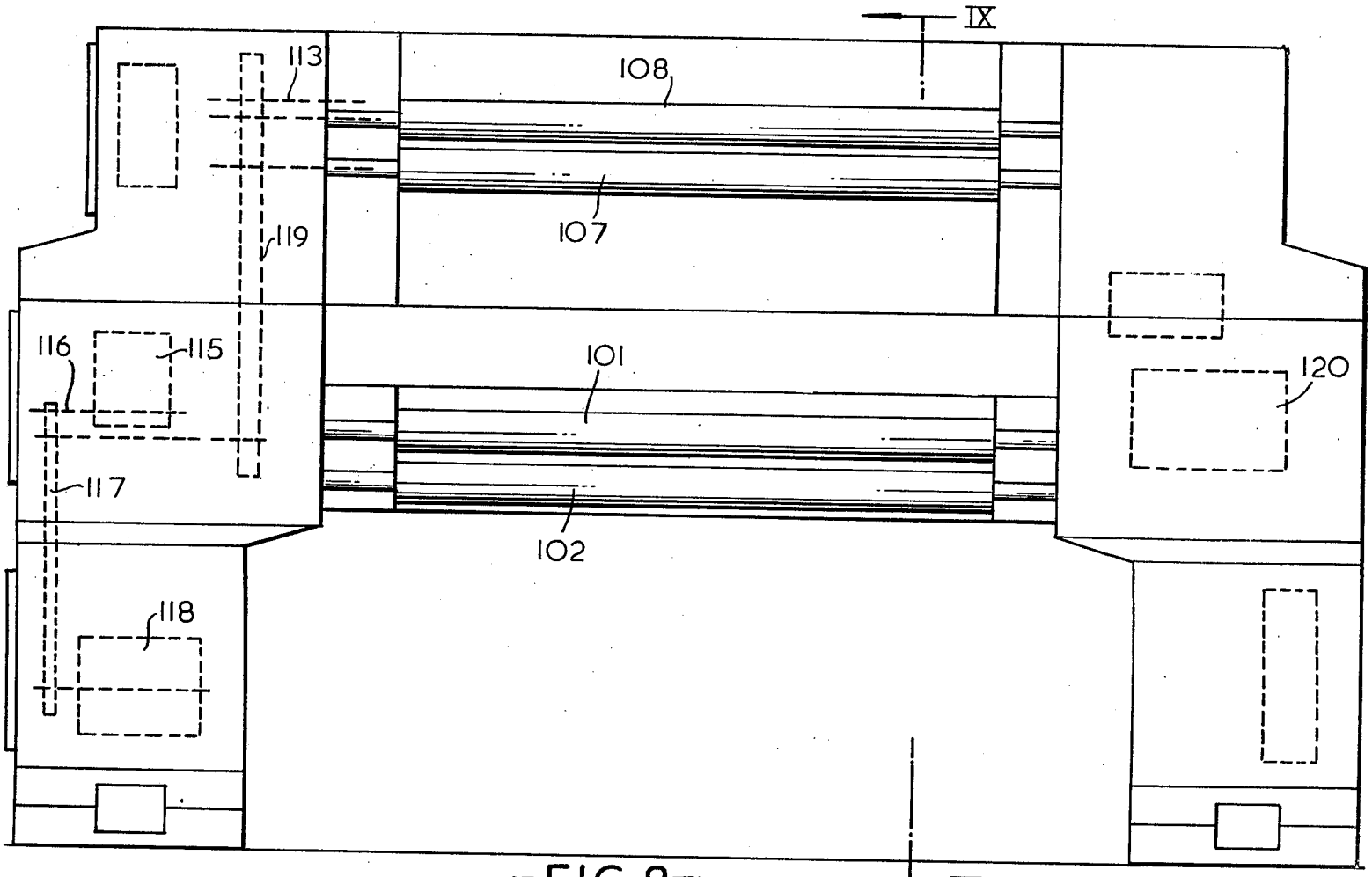
FIG. 8 is a front view of a machine for carrying out the method illustrated in FIGS. 1 to 7.

The machine shown in FIGS. 8 to 10 has a large number of needles similar to needle 12 spaced-apart across the width of the machine, each needle having its associated top looper 10 and bottom looper 11. The machine has cloth feed rollers 101, 102, a guide roller 103, cloth temple rollers 104 and 105, cloth output rollers 109, 110, and a further guide roller 111. The cloth 13 passes over the guide roller 103, through the feed rollers 101, 102, over the cloth temple rollers 104, 105, past the row of receiprocating needles 12, through the output rollers 109, 110, and finally over the guide roller 111. The yarn 15 is fed to the needles 12 by two yarn feed rollers 107 and 108.

The row of vertical needles 12 are reciprocated by a drive shaft 112 to which vertical reciprocatory movements are applied by a cam shaft 113. The row of bottom loopers 11 are controlled by a drive assembly 115 which is actuated by a cam shaft 116.

The row of top loopers 10 are connected to a support 114 the movements of which are controlled by a cam 123 (FIG. 10).

The cloth feed rollers 101 and 102 are driven through a V-belt drive 117 by an electric motor 118. The V-belt drive 117 also drives the cam shaft 116 of the bottom looper drive assembly 115.

The motor 118 also drives the yarn feed rollers 107 and 108, and the cam shaft 113, through the chain 119.

The full cycle carried out by the machine involves the following motions:

(1) Each needle 12 commences at bottom dead centre, rises to clear the fabric, and then moves downwardly again to a dwell position at a point adjacent the upper surface of the bottom looper 11. After the period of dwell, the needle returns to bottom dead centre, then rises to a position above the upper looper, and finally returns to bottom dead centre. This motion is applied to the needles by the cam shaft 113, which moves the needles via the shaft 112.

(2) The top loopers 10 remain stationary for the first three-quarters of the cycle whereupon they move one pitch sideways and remain in that new position until three-quarters of the next cycle has been completed, whereupon they return to their original position. This motion is applied via the support 114, and the support 114 is moved back and forth as necessary by the action of the cam 123 shown in FIG. 10. The cam shaft carrying the cam 123 is driven by the drive 119.

(3) Each bottom looper 11 starts at a position at which its tip lies adjacent to the associated needle and the tip then moves slightly past the needle in the direction of arrow B and then returns in the direction of arrow C to a dwell position in which it once again lies adjacent to the needle. The bottom looper then moves completely clear of the needle in the direction of arrow C, moves past the needle again in the direction of arrow B, moves completely clear of the needle again in the direction of arrow C, and finally moves in the direction of arrow B once more to reach its starting position. This motion is provided by the cam shaft 116, which acts on the drive assembly 115.

(4) After each cycle has been half completed, the yarn 15 must be tensioned, to draw a loop off each bottom looper 11 and over the associated needle, and this tensioning is carried out by a tensioning bar 121 which is moveable in the direction of arrow 121*a* (FIG. 9) to urge the yarn between two rigid bars 121*b* and 121*c*. The movement of the tensioning bar 121 at the appropriate time is controlled by an eccentric mounted on the cam shaft 113 and connected to the tensioning bar 121.

(5) After the loop 16 has been pulled off the bottom looper 11 by the tensioning bar 121, and the needle 12 has been raised, further tension must be applied to draw the non-pile loop 16 tightly around the pile loop 18 and this tension is applied by a further tensioning bar 130 which is movable in the direction of arrow 131 to pull the yarn against a stationary bar 132. The tensioning bar 130 is driven from a further eccentric on the cam shaft 113.

After each piercing of the base cloth by the needles, the temple rollers 4 and 5 are given a slight transverse or sideways shogging movement so that the points pierced by each needle lie on a zig-zag path as illustrated in FIG. 11. This means that the loops are not arranged in straight parallel lines with an expanse of bare base fabric between them, as would be the case if the loops lay on the chain lines shown in FIG. 11. Each loop extends across the fabric slightly, as well as along the length of the fabric, and this gives the impression of a denser and more even pile. The back and forth movement is imparted to the temple rollers 104 and 105 by a shogging mechanism 120 which comprises a cam 140 acting on two pegs 141 attached to a shaft 142. The shaft 142 is attached to the temple rollers 104 and 105.

The coverage and denseness of the pile can be increased by increasing the degree of movement of the temple rollers 104, 105. For example by using an alternative cam, the stitch formation can be arranged to follow the path shown in FIG. 12.

FIG. 13 shows at 150, in diagrammatic form, the way the yarn 15 is stitched into the base fabric 13. There are a succession of contiguous loops on the upper side of the base fabric and a succession of spaced-apart loops on the lower side of the base fabric. Alternate upper loops are held away from the base fabric by the top looper to form a first set of pile loops 151. The loops inbetween the pile loops 151 are drawn against the base fabric to form a first set of non-pile loops 152.

Alternate lower loops are also held away from the base fabric, by the bottom looper, to form a second set of pile loops 153. The loops in between the pile loops 153 are each passed around one of the pile loops 153 to form a second set of non-pile loops 154, each locking one of the pile loops 153 in position.

However the method according to the invention may be used to produce an alternative form of stitch formation to that shown at 150 in FIG. 13. The operations performed above the fabric may be displaced with respect to the lower loops by one stitch pitch in the direction of feed of the fabric, so that the loops 152 are held up by the top looper as pile loops, and the loops 151 are drawn against the base fabric as non-pile loops. This produces a stitch formation as shown at 160 in FIG. 13, with the non-pile loops 154 lying on the side of the base fabric which is immediately opposite the upper pile loops, instead of immediately opposite the upper non-pile loops as shown at 150.

The invention is not restricted to the details of the foregoing embodiments. For example the necessary motions may be imparted by control elements other than cams.

In the description of the above embodiments, the fabric has been regarded as being stationary during that period of the cycle in which it is pierced by each needle. In fact the fabric feed rollers rotate continuously, the output rollers travelling slightly faster than the input rollers so that the fabric is under tension. However in the region of the needles the fabric does tend to move incrementally because when the pile fabric is pierced by the needles this tends to halt movement of the fabric, the tension of the fabric between the output roller and the needles increasing momentarily.

When the needle 12 and bottom looper 11 are in the position shown in FIG. 3, the point of the needle lies directly above the bottom looper. However the needle and looper associate to arrange that during picking off of loops, such as shown in FIGS. 1, 4, and 7, they each deflect sideways slightly on interengagement so that the bottom looper is able to slide past the needle.

I claim:

1. A method of forming a double-sided pile fabric including repeatedly effecting the cycle comprising:

a. projecting a reciprocating eyed needle carrying yarn through said base fabric from one side thereof to form a non-pile loop of yarn on the other side of said base fabric;

b. advancing a first latchless looper through said non-pile loop;

c. retracting said needle to a position spaced from said one side of said base fabric while said non-pile loop is retained on said first looper;

d. advancing said base fabric along a path;

e. projecting said needle carrying said yarn through said base fabric to a dwell position wherein the point of said needle is adjacent said first looper to form a pile loop of yarn on said other side of said base fabric;

f. tensioning said yarn to cause said non-pile loop to slide off said first looper and about the end of said needle and to tighten around said needle and pile loop and against said other side of said base fabric;

g. withdrawing said first looper;

h. further advancing said needle with said pile loop;

i. advancing said first looper through said pile loop;

j. retracting said needle to a position spaced from said one side of said base fabric while said pile loop is retained on said first looper;

k. advancing said base fabric along said path and withdrawing said pile loop from said first looper; and l. retaining said yarn with a reciprocating second latchless looper spaced from said one side of said base fabric while said needle is moved towards said base fabric following one of said steps (d) and (k) to form a pile loop on said one side of said base fabric;

m. whereby a succession of contiguous loops are formed on said one side of said base fabric and a succession of spaced-apart loops are formed on the other side of said base fabric.

2. A method of manufacturing a double sided pile fabric as claimed in claim 1 wherein said cycle is repeatedly effected by each of a plurality of said needles, each with its associated first looper and second looper, forming a plurality of parallel rows of stitches.

3. A method of manufacturing a double sided pile fabric as claimed in claim 1 wherein said fabric is moved slightly in a direction transverse to the path of said fabric each time said needle is retracted such that the points on said fabric at which said needle pierces said fabric lie in a zig-zag path on said fabric.

4. A method of manufacturing a double sided pile fabric as claimed in claim 1 wherein step (l) follows step (k) whereby each of said non-pile loops is passed around an adjacent pile loop and extends over that part of said base fabric on said other side thereof which is immediately opposite the space between said spaced-apart loops on said one side of said base fabric.

5. A method of manufacturing a double sided pile fabric as claimed in claim 1 wherein step (l) follows step (d) whereby each of said non-pile loops is passed around an adjacent pile loop and extends over that part of said base fabric on said other side thereof which is immediately opposite one of said spaced-apart loops on said one side of said base fabric.

6. A method of manufacturing a double sided pile fabric as claimed in claim 1 wherein said first looper with said non-pile loop retained thereon is withdrawn to a dwell position during step (d).

7. A machine for manufacturing a double sided pile fabric comprising:

a. at least one eyed needle;

b. drive means to reciprocate the needle through a base fabric;

c. means to feed the base fabric along a path past the needle so that, as the needle reciprocates, a yarn passing through the eye of the needle is passed from one side through to the other side the base fabric at a succession of spaced-apart points to form a succession of spaced-apart loops on one side of the base fabric and a succession of alternate non-pile loops and adjacent pile loops on the other side of the base fabric;

d. a first latchless looper spaced from the other side of said path of the base fabric;

e. means to provide relative displacement between said first looper and said needle so that said first looper alternately retains each alternate non-pile loop and each adjacent pile loop away from the other side of said base fabric and positions said first looper, while said looper is retaining each alternate non-pile loop, in advance of the point of said needle forming each adjacent pile loop;

f. means to pull the yarn forming said alternate non-pile loop while said first looper is positioned adjacent the point of said needle such that said alternate non-pile loop is slid off said first looper and about the point of said needle and tightened around said needle and adjacent pile loop and against the other side of said base fabric whereby a first set of pile loops is formed on the other side of said base fabric;

g. a second latchless looper spaced from said one side of said path of said base fabric; and h. means to provide relative displacement between said second looper and said needle so that on alternate strokes of said needle the needle travels along one side of said second looper and then back along the other side of said second looper, carrying the yarn with it whereby alternate loops of the yarn are held away from the base fabric by said second looper to form a set of spaced-apart pile loops on the one side of said base fabric.

8. A machine as claimed in claim 7 wherein said drive means to reciprocate said needle comprises first cam means.

9. A machine as claimed in claim 7 wherein said means to provide relative displacement between said second looper and said needle comprises second cam means for moving said second looper from one side of said needle to the other side thereof on alternate strokes of said needle.

10. A machine as claimed in claim 7 wherein said means to provide relative displacement between said first looper and said needle comprises third cam means.

11. A machine as claimed in claim 7 in which said means to pull the yarn forming each of said alternate non-pile loops comprises at least one tensioning bar and eccentric means to urge said bar against said yarn.

12. A machine as claimed in claim 7 including means to reciprocate said base fabric cloth with respect to said needle in a direction transverse to the direction of movement of said cloth along said path so that the succession of spaced-apart points at which said needle pierces said base fabric lie on a zig-zag path.

13. A machine as claimed in claim 7 comprising a plurality of said eyed needles, each with its associated first looper and second looper.

14. A machine as claimed in claim 7 wherein the side of said first looper remote from said base fabric includes a curved surface extending to the free end thereof whereby said alternate non-pile loop may be more easily slid off said first looper when tension is applied by said means to pull the yarn forming said alternate non-pile loop.

* * * * *